US009302685B2

(12) United States Patent
Goding

(10) Patent No.: US 9,302,685 B2
(45) Date of Patent: Apr. 5, 2016

(54) RAILWAY TRUCK HAVING BOLSTER-SUSPENDED TRACTION MOTOR

(71) Applicant: Electro-Motive Diesel, Inc., LaGrange, IL (US)

(72) Inventor: David J. Goding, Palos Park, IL (US)

(73) Assignee: Electro Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/681,982

(22) Filed: Apr. 8, 2015

(65) Prior Publication Data

US 2015/0210298 A1 Jul. 30, 2015

Related U.S. Application Data

(62) Division of application No. 13/665,610, filed on Oct. 31, 2012, now Pat. No. 9,032,881.

(51) Int. Cl.

| | |
|---|---|
| ***B61F 3/00*** | (2006.01) |
| ***B61F 3/04*** | (2006.01) |
| ***B61C 5/00*** | (2006.01) |
| ***B61C 17/00*** | (2006.01) |
| ***B61F 5/08*** | (2006.01) |
| ***B61F 5/04*** | (2006.01) |

(52) U.S. Cl.

CPC ... *B61F 3/04* (2013.01); *B61C 5/00* (2013.01); *B61C 17/00* (2013.01); *B61F 5/04* (2013.01); *B61F 5/08* (2013.01)

(58) Field of Classification Search

CPC ..... B61F 1/08; B61F 3/04; B61F 5/08; B61F 5/38; B61F 3/06; B61F 5/00; B61F 5/36; B61F 5/44; B61F 5/325; B61C 17/00; B61C 5/00

USPC ..... 105/96, 196, 166, 136, 157.1, 167, 168, 105/194

See application file for complete search history.

(56) References Cited

U.S. PATENT DOCUMENTS 4,231,296 A * 11/1980 Jackson ..... 105/136
4,485,743 A 12/1984 Roush et al.

(Continued)

OTHER PUBLICATIONS http://www.railroadforums.com/photos/data/589/1123_731_nova_granja_03jun2005.jpg (prior to Feb. 21, 2012).

(Continued)

*Primary Examiner* — Jason C Smith

(57) ABSTRACT

A two-axle sub-truck is disclosed. The two-axle sub-truck may include a first axle and a second axle. The two-axle sub-truck may also include a first traction motor located between the first and second axles and a second traction motor located outside the first and second axles.

10 Claims, 4 Drawing Sheets

(56) References Cited

U.S. PATENT DOCUMENTS

| | | | | |
|---|---|---|---|---|
| 4,628,824 | A | 12/1986 | Goding et al. | |
| 4,679,506 | A * | 7/1987 | Goding et al. | 105/136 |
| 4,679,507 | A * | 7/1987 | Rassaian | 105/136 |
| 4,765,250 | A * | 8/1988 | Goding | 105/166 |
| 4,841,873 | A | 6/1989 | Goding et al. | |
| 5,613,444 | A * | 3/1997 | Ahmadian et al. | 105/166 |
| 5,746,135 | A * | 5/1998 | Ahmadian et al. | 105/196 |
| 6,871,598 | B2 * | 3/2005 | Schaller et al. | 105/168 |
| 8,833,266 | B2 * | 9/2014 | Goding | 105/157.1 |
| 8,943,977 | B2 | 2/2015 | Goding | |
| 2005/0183625 | A1 | 8/2005 | Goding et al. | |
| 2014/0116287 | A1 * | 5/2014 | Goding | 105/96 |

OTHER PUBLICATIONS http://www.railpictures.net/images/d1/2/4/3/8243.1296750113.jpg (prior to Feb. 21, 2012).

U.S. Appl. No. 13/409,100, entitled "Railway Truck Having Axle-Pinned Equalizer," filed Feb. 29, 2012.

U.S. Appl. No. 13/409,101, entitled "Railway Truck Having Equalizer-Linked Frame," filed Feb. 29, 2012.

U.S. Appl. No. 13/409,079, entitled "Frame for Railway Truck," filed Feb. 29, 2012.

U.S. Appl. No. 61/634,534, entitled "Railway Truck Having Spring-Connected Equalizer and Frame," filed Feb. 29, 2012.

U.S. Appl. No. 13/409,102, entitled "Railway Truck Having Spring-Connected Equalizer and Frame," filed Mar. 1, 2012.

* cited by examiner

RAILWAY TRUCK HAVING BOLSTER-SUSPENDED TRACTION MOTOR

This application is a divisional of U.S. patent application Ser. No. 13/665,610, filed Oct. 31, 2012 and entitled "RAILWAY TRUCK HAVING BOLSTER-SUSPENDED TRACTION MOTOR," the entire disclosure of which is incorporated herein by reference.

TECHNICAL FIELD

The present disclosure relates generally to a railway truck and, more particularly, to a railway truck having a traction motor suspended from a bolster of the railway truck.

BACKGROUND

Locomotives traditionally include a car body that houses one or more power units of the locomotive. The weight of the car body is supported at either end by trucks that transfer the weight to opposing rails. The trucks typically include cast or fabricated steel frames that provide a mounting for traction motors, axles, and wheel sets. Each railway truck is configured to pivotally support a base platform of the car body by way of a common bolster. Locomotives can be equipped with trucks having two, three, or four axles.

In some situations, operation of the locomotive can be less than optimal due to poor transfer of weight between axles due to traction and/or braking forces. In particular, when the locomotive is stationary, the weight on each axle is configured to be approximately equal. During operation, however, as the locomotive brakes, accelerates, and/or turns, forces can transfer from one axle to another, resulting in different axles carrying unequal loads. Wheels carrying lighter loads can lose proper traction and therefore be vulnerable to slipping. Accordingly, the varying loads on different axles can reduce the durability, stability, and reliability of the truck.

Force transfer can result from numerous factors related to truck design. For example, a significant amount of force transfer can be attributed to the arrangement of the traction motors within the truck. Typically, in two-axle trucks, the traction motors are arranged symmetrically about a center transom of the frame, with an inner end of each traction motor facing each other. An example of a four-axle articulated locomotive truck with this configuration is disclosed in U.S. Pat. No. 4,485,743 that issued to Roush et al. ("Roush") on Dec. 4, 1984.

Although typical, the arrangement of traction motors disclosed in Roush may be less than optimal. This is because the symmetrical arrangement of traction motors can result in opposing reaction forces during operation of the locomotive. Such forces can generate moments that cause the frame to pitch and therefore result in undesirable force transfer between axles. This force transfer can limit the tractive capability of the axles when lightly loaded and overload the traction motors when the axles are heavily loaded.

The railway truck of the present disclosure solves one or more of the problems set forth above and/or other problems in the art.

SUMMARY

In one aspect, the present disclosure is related to a railway truck. The railway truck may include a first axle, a second axle, a plurality of wheels connected to each of the first and second axles, a frame connecting the first and second axles, and a bolster assembly pivotally connected to the frame. The railway truck may also include a traction motor configured to drive the first axle. The railway truck may further include a torque reaction link connected between an end of the bolster assembly and a side of the traction motor.

In another aspect, the present disclosure may be related to a bolster assembly. The bolster assembly may include a span bolster having a first end and an opposing second end, a pivot pin located at a general longitudinal and transverse center of the span bolster and connected to an upper surface of the span bolster, and a mounting member configured to receive a torque reaction link at an end of the bolster assembly at a bottom surface. The bolster assembly may also include a safety hook connected to the bottom surface of the bolster assembly and positioned adjacent to the mounting member. The safety hook may be configured to slidingly engage a bracket.

DETAILED DESCRIPTION

Figure 1:
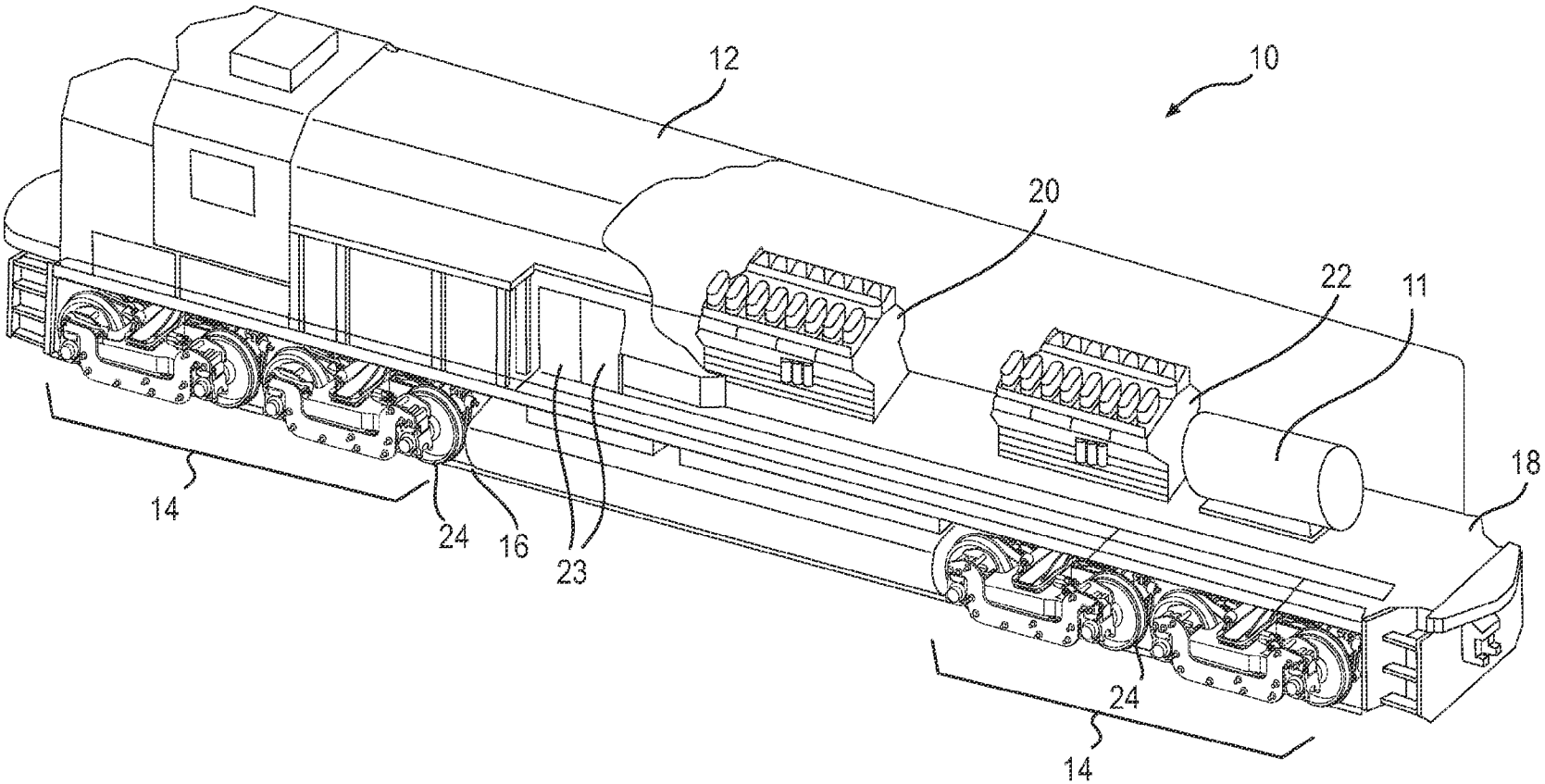
FIG. 1 is a pictorial illustration of an exemplary disclosed locomotive.

FIG. 1 illustrates an exemplary embodiment of a locomotive 10. Locomotive 10 may provide the motive power for a train and may include a car body 12 supported at opposing ends by a plurality of trucks 14 (e.g., two trucks 14). Each truck 14 may be oriented symmetrically about a center of locomotive 10. Trucks 14 may include a leading truck and a trailing truck. For the purposes of this disclosure, leading and trailing are defined with respect to a travel direction of trucks 14. Trucks 14 may be configured to engage a track 16 and support a base platform 18 of car body 12. Any number of engines may be mounted to base platform 18 and configured to drive a plurality of wheels 24 included within each truck 14. In the exemplary embodiment shown in FIG. 1, locomotive 10 includes a first engine 20 and a second engine 22 that are lengthwise aligned on base platform 18 in a travel direction of locomotive 10. One skilled in the art will recognize, however, that first and second engines 20, 22 may be arranged in tandem, transversally, or in any other orientation on base platform 18.

Car body 12 may be fixedly or removably connected to base platform 18 to substantially enclose first and second engines 20, 22, while still providing service access to first and second engines 20, 22. For example, car body 12 may be welded to base platform 18 and include one or more access doors 23 strategically located in the vicinity of first and second engines 20, 22. Alternatively, car body 12 may be attached to base platform 18 by way of fasteners such that portions or all of car body 12 may be completely removed from base platform 18 to provide the necessary access to first and second engines 20, 22. It is contemplated that car body 12 may alternatively be connected to base platform 18 in another manner, if desired.

Figure 2:
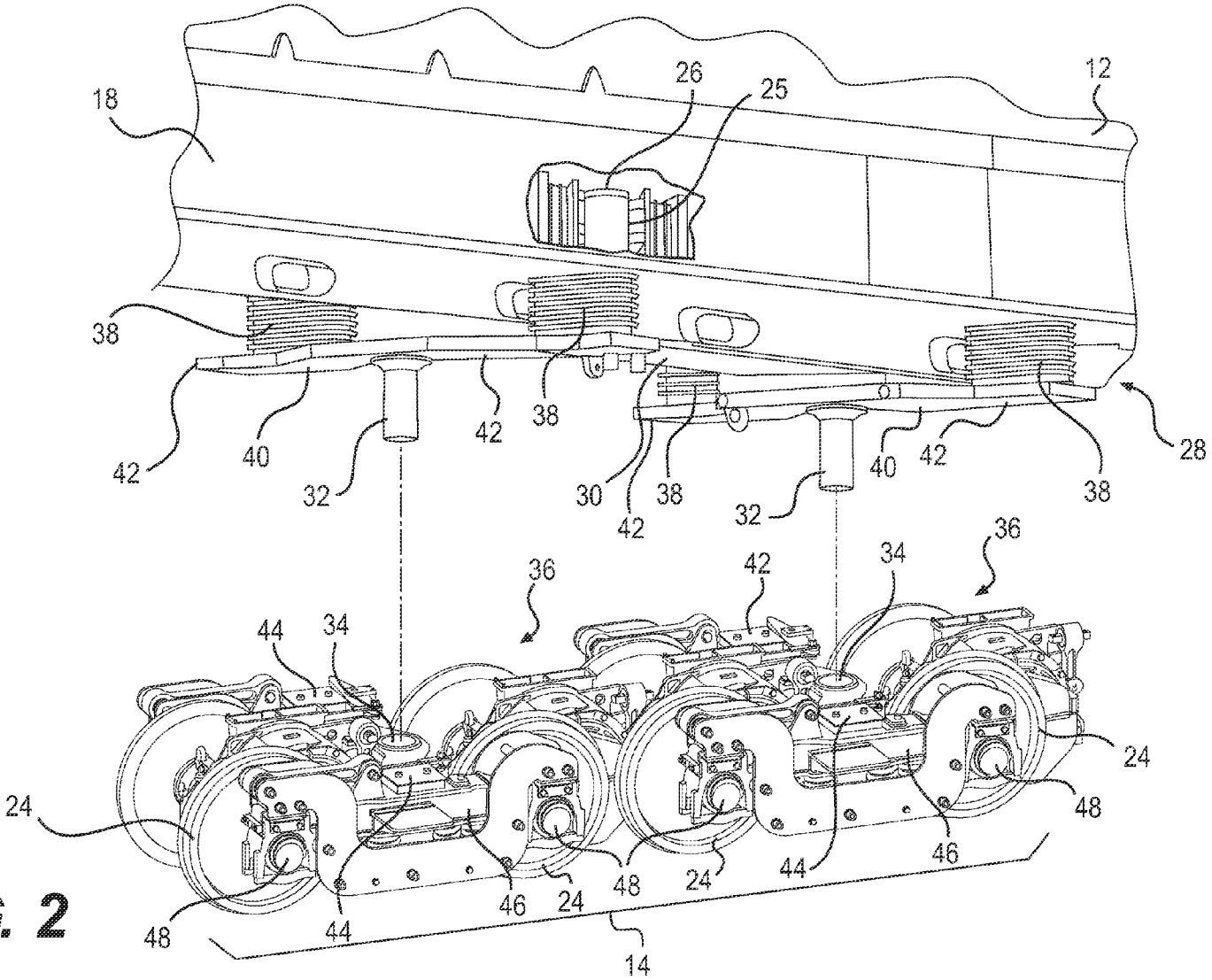
FIG. 2 is a semi-exploded diagrammatic illustration of an exemplary disclosed truck and bolster assembly that may be used in conjunction with the locomotive of FIG. 1.

Base platform 18 may be configured to pivot somewhat relative to trucks 14 during travel of locomotive 10 along a curving trajectory of tracks 16. As shown in FIG. 2, base platform 18 may be provided with a pivot shaft 25 at each end (only one end shown in FIG. 2) that extends downward from a transverse center to engage a pivot pin 26 within a bolster assembly 28. Pivot pin 26 may be lined with a low-wear material, for example nylon. Bolster assembly 28 may include a generally hollow beam (also known as a span bolster) 30 that is fixedly or flexibly connected to pivot pin 26 and extends in a lengthwise direction of base platform 18. In the disclosed embodiment, span bolster 30 is fixedly connected to pivot pin 26 by way of welding. Additional pivot shafts 32 may extend downward from opposing ends of span bolster 30 away from car body 12 to engage pivot housings 34 within separate sub-trucks 36 of each truck 14, thereby pivotally linking sub-trucks 36 together and to car body 12. In this configuration, car body 12 and sub-trucks 36 may all pivot independently relative to bolster assembly 28, allowing locomotive 10 to follow a curving trajectory of tracks 16. Pivot shaft 25 may be designed to transmit tractive forces (i.e., forces in a fore/aft direction, including propelling and braking forces) and lateral (i.e., side-to-side) forces between car body 12 and span bolster 30, with minimal transmission of vertical forces (i.e., weight of locomotive 10). Similarly, pivot shafts 32 may be designed to transmit these same tractive and lateral forces between span bolster 30 and sub-trucks 36, with minimal transmission of vertical forces.

Span bolster 30 may be spaced apart from base platform 18 by way of a plurality of resilient members (e.g., springs) 38 located in pairs in general fore/aft alignment with pivot shafts 32 at the sides of base platform 18. In particular, bolster assembly 28 may include transverse arms 40 located near the ends of span bolster 30 and rigidly connected to pivot shafts 32. Springs 38 may be sandwiched between distal tips 42 of arms 40 and an underside of base platform 18. In the disclosed embodiment, springs 38 may include rubber compression pads that are removably connected to arms 40 of span bolster 30 and pinned to base platform 18, although other configurations of springs 38 may also be utilized. Springs 38 may be configured to undergo a shearing motion during pivoting of base platform 18 relative to span bolster 30. Springs 38 may be configured to transmit vertical and lateral forces between car body 12 and span bolster 30, with minimal transmission of tractive forces.

Span bolster 30 may be similarly spaced apart from sub-trucks 36 by way of additional resilient members (e.g., springs) 44 located in pairs in general fore/aft alignment with pivot housings 34 at the sides of sub-trucks 36. In particular, springs 44 may be removably connected to a frame 46 of each sub-truck 36 and pinned to an underside of span bolster 30 (e.g., to an underside of arms 40) in the same manner that springs 38 are connected to arms 40 and pinned to car body 12. Similar to springs 38, springs 44 may be rubber compression pads that are configured to undergo a shearing motion during lateral displacement (i.e., pivoting) of sub-trucks 36 relative to span bolster 30. In this configuration, springs 44 may be configured to transmit vertical forces between sub-trucks 36 and span bolster 30, with minimal transmission of tractive or lateral forces.

Springs 44 may be located immediately below springs 38 to reduce stresses induced within span bolster 30 by vertical forces. In particular, vertical forces from frame 46 may pass through springs 44 and then through springs 38 into base platform 18, with reduced transmission of forces in transverse directions through span bolster 30. This configuration may help reduce distortion of span bolster 30 due to vertical force transmission.

Figure 3:
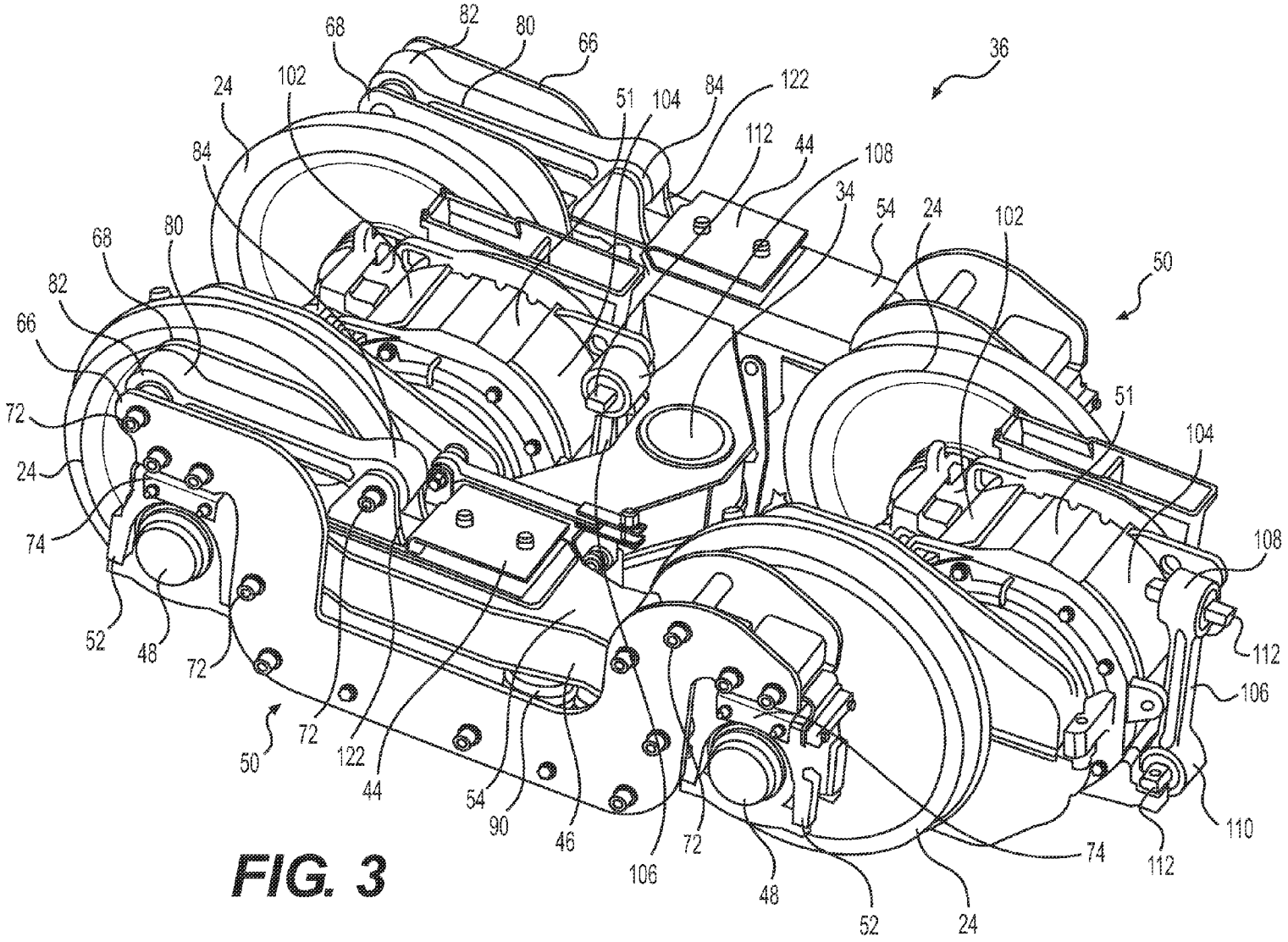
FIG. 3 is a pictorial illustration of an exemplary disclosed sub-truck that may be used in conjunction with the truck of FIG. 2.

An exemplary embodiment of one sub-truck 36 of truck 14 is shown in FIG. 3. It should be noted, however, that all sub-trucks 36 within locomotive 10 may be substantially identical. Each sub-truck 36 may be an assembly of components that together transfers lateral, tractive, and vertical forces between tracks 16 and car body 12. For example, each sub-truck 36 may include, among other things, wheels 24, a plurality of axles 48 connected between opposing wheels 24, frame 46, and an equalizer 50 located at each side of sub-truck 36 to connect wheels 24 with frame 46 and to help distribute vertical loads between axles 48.

Figure 4:
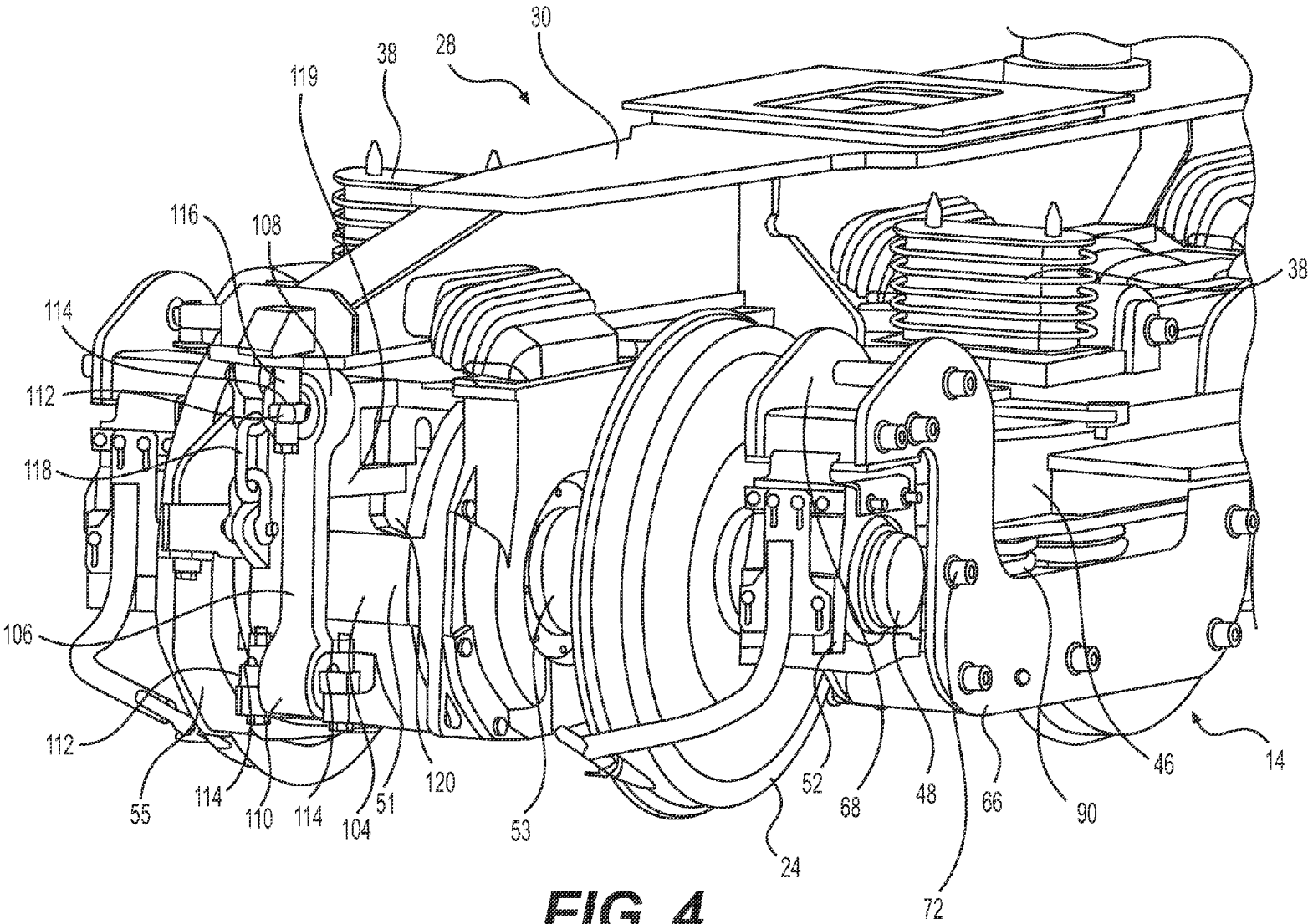
FIG. 4 is an enlarged pictorial illustration of a portion of the truck and bolster assembly of FIG. 2.

Two wheels 24 may be rigidly connected at the opposing ends of each axle 48 such that wheels 24 and axles 48 all rotate together. Axles 48 may include an inboard axle closer to a center of truck 14 and an outboard axle closer to an end of truck 14. A traction motor 51, for example an electric motor driven with power generated by first and second engines 20, 22 (referring to FIG. 1), may be disposed at a lengthwise center of each axle 48. Traction motor 51 may be configured to power wheels 24 via axles 48, thereby driving locomotive 10. The opposing ends of axles 48 may be held within separate bearing assemblies 52 such that forces (i.e., lateral, tractive, and vertical forces) may be transferred from wheels 24 through axles 48 and bearing assemblies 52 to the remaining components of sub-truck 36. Each traction motor 51 may be provided with an armature bearing 53 at a first axial end, as shown in FIG. 4. Armature bearing 53 may be tied to traction motor 51 and disposed along a general lengthwise center of axles 48 between wheels 24. A gear case 55 may be located on an opposite axial end of traction motor 51. Gear case 55 may be bolted to traction motor 51 via brackets and enclose mateable components such as a bull gear and pinion gear (not shown), which operate together to drive axles 48 and wheels 24.

Each traction motor 51 may include a first and second side 102, 104 disposed in general fore/aft alignment with the corresponding axle 48 (referring to FIG. 3). First side 102 of traction motor 51 may be vertically supported by support bearings of the associated axle 48, while second side 104 of traction motor 51 may be suspended from span bolster 30 by way of a torque reaction link 106. Torque reaction link 106 may be mounted in a generally vertical orientation, orthogonal to axle 48, at a general distance lengthwise from a center of each axle 48.

As shown in both FIGS. 3 and 4, torque reaction link 106 may be a rigid member and rounded first and second ends 108, 110. First and second ends 108, 110 may have a circular opening configured to receive a crosspiece 112. A rubber bushing may be disposed between crosspiece 112 and the circular opening of first and second ends 108, 110. First end 108 may be configured to pivot in a first direction and second end 110 may be configured to pivot in a second direction generally orthogonal to the first direction, although the rubber bushing may allow for rotation in all directions, including torsional and conical rotation. First end 108 may be configured to receive crosspiece 112 in a direction generally parallel to a lengthwise direction of span bolster 30 and a travel direction of locomotive 10, while second end 110 may be configured to receive crosspiece 112 in a direction generally parallel to axles 48. It is contemplated that first and second ends 108, 110 may alternatively be configured to receive crosspiece 112 in different directions, if desired.

Each crosspiece 112 may include bores 114 at opposing ends that are used to pivotally connect first and second ends 108, 110 of torque reaction link 106 to span bolster 30 and traction motor 51, respectively. First end 108 and bores 114 of crosspiece 112 may be configured to each receive a vertically-oriented tube 116 connected to a bottom of span bolster 30 by way of welding. Tube 116 may be configured to receive bolts threaded through bores 114 of crosspiece 112 to retain torque reaction link 106 connected to span bolster 30 at first end 108. In this manner, tubes 116 may help transfer torque reactions between traction motors 51 and span bolster 30, pivoting somewhat in a lateral direction. At second end 110, bores 114 of crosspiece 112 may be configured to receive bolts to pivotally secure torque reaction link 106 to second side 104 of traction motor 51. Torque reaction link 106 may be able to pivot in a fore/aft direction to permit the transfer of torque from span bolster 30 into axles 48.

Each traction motor 51 may be suspended from span bolster 30 by substantially identical torque reaction links 106 generally located equidistant from each other along a longitudinal length of span bolster 30. In the disclosed embodiment, truck 14 includes two traction motors 51 in each sub-truck 36 of each truck 14 (e.g., four motors total in the disclosed truck). Span bolster 30 may therefore be attached to four traction motors 51 spaced along the longitudinal length of span bolster 30. In the disclosed embodiment, one traction motor 51 of each sub-truck 36 may reside between axles 48 (e.g., associated with a leading axle of the associated sub-truck 36 of the leading railway truck and with a trailing axle of the associated sub-truck 36 of the trailing railway truck) and the other traction motor 51 may reside outside axles 48 (e.g., associated with a trailing axle of the associated sub-truck 36 of the leading railway truck and with a leading axle of the associated sub-truck 36 of the trailing railway truck). This arrangement may allow for axles 48 to be located closer together.

Span bolster 30 may include one or more safety features that help to prevent complete separation of traction motor 51 from span bolster 30 in the event of a loosening or failure of torque reaction link 106. For example, span bolster 30 may include a safety link 118 attached to second side 104 of traction motor 51 at a position adjacent to torque reaction link 106. Safety link 118 may be positioned generally parallel to torque reaction link 106 and bolted to a bottom side of span bolster 30 and second side 104 of traction motor 51. Safety link 118 may exhibit sufficient flexibility to avoid interference with the fore/aft pivoting of torque reaction link 106, while exhibiting sufficient strength to support traction motor 51 during a failure condition of torque reaction link 106. In this manner, safety link 118 may serve as a redundant connection vis-á-vis torque reaction link 106 by preventing traction motor 51 from engaging track 16 during a failure condition of torque reaction link 106.

It is contemplated that alternative safety brackets may be utilized, if desired. For example, span bolster 30 may include a safety hook 119 fabricated as a single piece in a general C-shape. Safety hook 119 may be positioned adjacent to and generally in parallel with torque reaction link 106, and configured to engage a corresponding bracket 120 attached to second side 104 of traction motor 51 at a position adjacent to torque reaction link 106. Bracket 120 may similarly be fabricated as a single piece in a general C-shape, and may slidingly engage safety hook 119 while still permitting vertical support Like safety link 118, the interaction of safety hook 119 and bracket 120 may exhibit sufficient flexibility to avoid interference with torque reaction link 106, while also exhibiting sufficient strength to support traction motor 51 in the event of a failure of torque reaction link 106.

Frame 46 may be a fabrication of multiple components, including pivot housing 34 and substantially identical left and right arm members 54 that extend from pivot housing 34 in a lengthwise direction of sub-truck 36 to form a general H-shape (referring to FIG. 3). In this embodiment, pivot housing 34 may be an integral cast component having a center opening that is lined with a low-wear material, for example nylon, that is configured to receive pivot shaft 32 of bolster assembly 28 (referring to FIG. 2). Each of arm members 54 may be joined to opposing ends of pivot housing 34 by way of welding or mechanical fastening, as desired.

Equalizer 50 may be an assembly of components that together facilitate the transfer of forces between bearing assemblies 52 and frame 46 (referring to FIG. 3). In particular, equalizer 50 may include, among other things, an outer plate 66 and a substantially identical inner plate 68 that are held apart from each other by one or more spacers (not shown) and clamped together by one or more rivets 72 or other fasteners. Each of outer and inner plates 66, 68 of each equalizer 50 may be generally planar and fabricated as a single piece from flat stock in a general U-shape. The absence of welding between outer and inner plates 66, 68 of equalizer 50 may permit the use of high-strength materials that typically are inconvenient to weld. Opposing ends of equalizer 50 may rest atop front- and aft-located bearing assemblies 52 at each side of sub-truck 36, with wear pads 74 located between equalizers 50 and bearing assemblies 52. In this manner, vertical forces may be transferred between equalizers 50 and bearing assemblies 52 via wear pads 74.

Tractive forces may be transferred between equalizers 50 and frame 46 by way of two longitudinal traction links 80 on each side of sub-truck 36. Traction links 80 may be positioned between outer and inner plates 66, 68 at a lengthwise position associated with a leading axle 48 of sub-truck 36 of the leading railway truck and a trailing axle 48 of sub-truck 36 of the trailing railway truck. In particular, traction links 80 may be pivotally held in place between inner and outer plates 66, 68 of equalizer 50 at a first end 82 by one of rivets 72. First end 82 may be located generally above and slightly offset from (e.g., rearward of) the associated axle 48, and radially inward of an outer periphery of wheels 24. Traction links 80 may be pivotally connected at an opposing second end 84 to frame 46 via a bracket 122 similarly secured by one of rivets 72. Bracket 122 may be welded to a top side of arm members 54 of frame 46 and positioned adjacent to (e.g., rearward of) springs 44. In the disclosed embodiment, bracket 122 generally abuts springs 44. It is contemplated that traction links 80 may alternatively be fastened to equalizer 50 and frame 46 by other means, such as a threaded nut and bolt, if desired.

When frame 46 and equalizer 50 are in equilibrium (i.e., not moving significantly relative to each other), traction links 80 may be generally horizontal. However, during relative movement between frame 46 and equalizer 50, traction links 80 may pivot in the vertical direction somewhat. In this configuration, traction links 80 may constrain frame 46 relative to equalizers 50 in the tractive direction, yet still allow some relative movement in the vertical direction through pivoting of traction links 80. In some embodiments, a rubber bushing provided with an inner metal member (not shown) may be located within first and/or second ends 82, 84 of traction links 80 to receive rivet 72, if desired. The rubber bushing may allow for some roll and/or yaw of frame 46 relative to equalizer 50.

One or more spring supports (not shown) may also be disposed transversely between outer and inner plates 66, 68 at a lower portion of equalizer 50 to facilitate vertical dampening of frame movement relative to equalizer 50. Spring supports may embody plates that are held in a generally horizontal position by rivets 72, each support being configured to receive a corresponding spring 90. Springs 90 may be sandwiched between equalizer 50 and an underside of frame 46. In this configuration, vertical forces may be transferred between frame 46 and equalizer 50 by way of springs 90.

INDUSTRIAL APPLICABILITY

The disclosed railway truck may provide a means for transferring tractive, transverse, and vertical forces between the wheels and the car body of a locomotive with reduced wear of components. This reduction of component wear may help to extend the useful life of the locomotive as well as reducing service costs. The transfer of forces between wheels 24 and car body 12 during operation of locomotive 10 will now be described.

During operation of locomotive 10, engines 20, 22 may power traction motors 51. In particular, traction motors 51 may convert electrical energy into mechanical energy to exert torque on wheels 24 via axles 48, thereby driving wheels 24 and propelling locomotive 10 in a travel direction. Because traction motors 51 may be arranged such that each torque reaction link 106 within each truck 14 faces the same direction, the reactionary forces associated with traction motors 51 may act in a single direction, thereby minimizing the pitching of sub-truck 36 and helping to equalize the loads among axles 48. In particular, torque reaction link 106 may be able to pivot in a fore/aft direction to permit the transfer of torque from span bolster 30 into axles 48. Tubes 116 associated with first end 108 of torque reaction link 106 may help transfer torque reactions between traction motors 51 and span bolster 30, pivoting somewhat in a lateral direction.

Reactionary forces associated with the forward or reverse motion of wheels 24 may be transferred from axles 48 to equalizers 50 by way of bearing assemblies 52 and rivets 72. Equalizers 50, having received these tractive forces from axles 48 at both ends, may transfer these forces to arm members 54 of frame 46 via brackets 122 and rivets 72 associated with traction links 80. Traction links 80, each located radially inward of the outer periphery of wheels 24, may create favorable torques and moments that aid in equalizing loads on wheels 24, thereby helping to reduce unfavorable force transfer. From arm members 54, the tractive forces may move inward through pivot housing 34 to pivot shaft 32 within bolster assembly 28, and from pivot shaft 32 through span bolster 30 and pivot pin 26 to pivot shaft 25. These tractive forces may then move from pivot shaft 25 through base platform 18 to car body 12. Reactionary tractive forces may then travel in reverse direction through these same components back to wheels 24.

Car body 12 and all components between car body 12 and wheels 24 may exert vertical forces on wheels 24 that can change based on vertical irregularities and/or vertical trajectory changes of tracks 16. Wheels 24 may support these vertical forces by way of axles 48, bearing assemblies 52, equalizers 50, frame 46, and springs 44, 38. In particular, wheels 24 may transfer vertical forces with bearing assemblies 52 via axles 48. Equalizers 50, resting atop bearing assemblies 52, may transfer the vertical forces therewith via wear pad 74. The vertical forces may be transferred between equalizers 50 and arm members 54 of frame 46 via the spring supports and springs 90. Frames 46 may transfer vertical forces with bolster assembly 28 via springs 44, while bolster assembly 28 transfers vertical forces with base platform 18 and car body 12 via springs 38.

During the transfers of forces described above, the different components of locomotive 10 may move relative to each other. For example, the ends of equalizers 50 may rock (i.e., yaw and roll) somewhat relative to the tops of bearing assembly 52. Similarly, frame 46 may move fore/aft and/or side-to-side somewhat relative to equalizers 50. Similarly, frame 46 of each sub-truck 36 may pivot relative to span bolster 30, while span bolster 30 may pivot relative to base platform 18 and car body 12.

Several additional benefits may be realized by the railway truck of the present disclosure. In particular, a reduced axle spacing may be achieved by suspending each of traction motors 51 from span bolster 30. Suspending traction motors 51 from span bolster 30 permits one traction motor 51 of sub-truck 36 to reside between axles 48 and the other traction motor 51 to reside outside axles 48. Axles 48 may be pushed closer to a longitudinal center of sub-truck 36 since traction motors 51 may not require support from frame 46. A reduced axle spacing may also facilitate greater room for a fuel tank (not shown), which can be placed between sub-trucks 36.

It will be apparent to those skilled in the art that various modifications and variations can be made to the disclosed railway truck without departing from the scope of the disclosure. Other embodiments of the railway truck will be apparent to those skilled in the art from consideration of the specification and practice of the railway truck disclosed herein. It is intended that the specification and examples be considered as exemplary only, with a true scope of the disclosure being indicated by the following claims and their equivalents.

What is claimed is:

1. A two-axle sub-truck, comprising:
- a first axle;
- a second axle;
- a first traction motor located between the first and second axles; and
- a second traction motor located outside the first and second axles
- a bolster assembly comprising:
  - a span bolster having a first end and an opposing second end;
  - a pivot pin located at a general longitudinal and transverse center of the span bolster and connected to an upper surface of the span bolster;
  - a mounting member configured to receive a torque reaction link at an end of the bolster assembly at a bottom surface; and
  - a safety hook connected to the bottom surface of the bolster assembly and positioned adjacent to the mounting member, wherein the safety hook is configured to slidingly engage a bracket.

2. The two-axle sub-truck of claim 1, further including:
- a first torque reaction link suspended from an end of the bolster assembly and pivotally connected to the first traction motor; and
- a second torque reaction link suspended from the bolster assembly and pivotally connected to the second traction motor.

3. The two-axle sub-truck of claim 2, wherein each of the first and second torque reactions link includes a rigid member with a first pivot end and a second pivot end.

4. The two-axle sub-truck of claim 3, wherein:
- the first pivot end is configured to pivot in a first direction; and
- the second pivot end is configured to pivot in a second direction generally orthogonal to the first direction.

5. The two-axle sub-truck of claim 1, wherein the first traction motor is associated with a leading one of the first and second axles of the railway truck relative to a travel direction of the railway truck.

6. The two-axle sub-truck of claim 1, wherein the first traction motor is associated with a trailing one of the first and second axles of the railway truck relative to a travel direction of the railway truck.

7. The two-axle sub-truck of claim 6, wherein the first and second torque reaction links are associated with a trailing side of the first and second traction motors relative to the travel direction of the railway truck.

8. The two-axle sub-truck of claim 7, wherein the first and second torque reaction links are associated with a leading side of the first and second traction motors relative to the travel direction of the railway truck.

9. The two-axle sub-truck of claim 1, wherein:

the mounting member is a first mounting member; and the bolster assembly further includes a substantially identical second mounting member at the opposing second end of the bolster assembly.

10. The two-axle sub-truck of claim 9, further including third and fourth substantially identical mounting members, wherein each of the third and fourth mounting members is located between the first and second mounting members.

* * * * *